United States Patent [19]

Westin

[11] 4,334,708

[45] Jun. 15, 1982

[54] ELECTROMAGNET FOR MOVING IRON OBJECTS

[76] Inventor: Karl H. Westin, c/o Janås, Kvickrotsgränd 158, S-162 42 Vällingby, Sweden

[21] Appl. No.: 195,421

[22] PCT Filed: Oct. 9, 1979

[86] PCT No.: PCT/SE79/00202

§ 371 Date: Jun. 6, 1980

§ 102(e) Date: Jun. 6, 1980

[87] PCT Pub. No.: WO80/00693

PCT Pub. Date: Apr. 17, 1979

[30] Foreign Application Priority Data

Oct. 11, 1978 [DE] Fed. Rep. of Germany ..... 7810640

[51] Int. Cl.[3] ..... B66C 1/06

[52] U.S. Cl. ..... 294/65.5

[58] Field of Search ..... 294/65, 65.5; 335/285-287, 289-292, 294, 295; 414/606, 737, 744 C

[56] References Cited

U.S. PATENT DOCUMENTS

| | | | |
|---|---|---|---|
| 1,200,404 | 10/1916 | White | 294/65.5 |
| 1,228,690 | 6/1917 | Monnet | 294/65 |
| 3,596,967 | 8/1971 | Carter | 294/65.5 |
| 4,129,328 | 12/1978 | Littell | 294/65 |

FOREIGN PATENT DOCUMENTS

| | | | |
|---|---|---|---|
| 1226263 | 10/1966 | Fed. Rep. of Germany | 335/291 |
| 2115847 | 10/1972 | Fed. Rep. of Germany | 294/65.5 |

*Primary Examiner*—Johnny D. Cherry

*Attorney, Agent, or Firm*—Birch, Stewart, Kolasch & Birch

[57] ABSTRACT

The invention relates to an electromagnet for moving iron objects. It is formed with opposing magnetic heads ($M_1$, $M_2$), mounted at the ends of a carrying shaft (1), to which is also attached a steel cable (9). The electromagnet ($M_1$, $M_2$) can be raised and lowered with the help of the cable (9). By the magnetic heads ($M_1$, $M_2$) being attached to the shaft (1) by ball joints, a vertical line from a suspension point in a suspension means for the cable (9) carrying the electromagnet passes practically straight through the center of gravity for the magnetic heads and the iron object to be lifted. A very safe lift is therefore obtained when lifting with the electromagnet.

18 Claims, 2 Drawing Figures

ELECTROMAGNET FOR MOVING IRON OBJECTS

BACKGROUND OF THE INVENTION

The invention relates to an electromagnet for moving iron objects.

The electromagnet is primarily intended for use in automatically handling objects arranged in no particular order. Examples of such handling are the transfer of iron objects from one transport pallet to another, from a pallet to a conveying path, and from such a path to a machine tool, or the reverse.

For moving iron objects with the electromagnet, the device has been given the characterizing features disclosed in the appended patent claims.

BRIEF DESCRIPTION OF THE DRAWINGS

An embodiment of the electromagnet in accordance with the invention is illustrated in the accompanying drawings, in which.

DETAILED DESCRIPTION OF THE INVENTION

Figure 1:
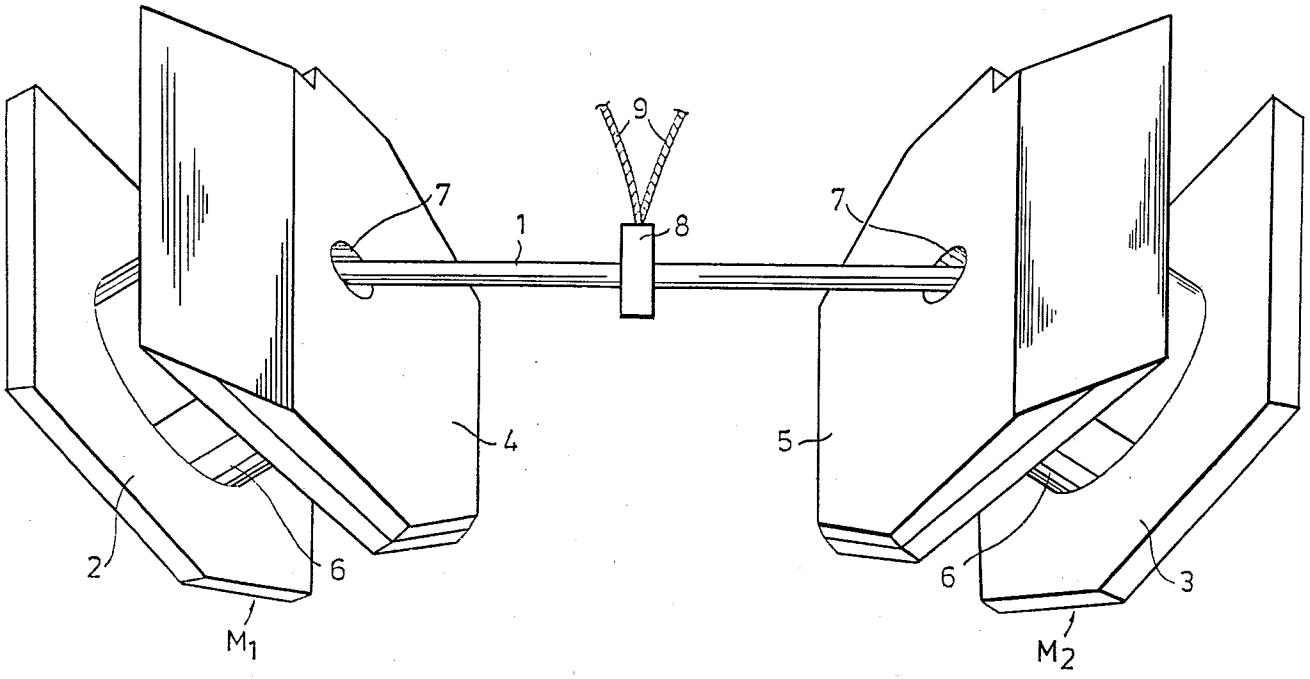
FIG. 1 illustrates the electromagnet as seen at an angle from above.
Figure 2:
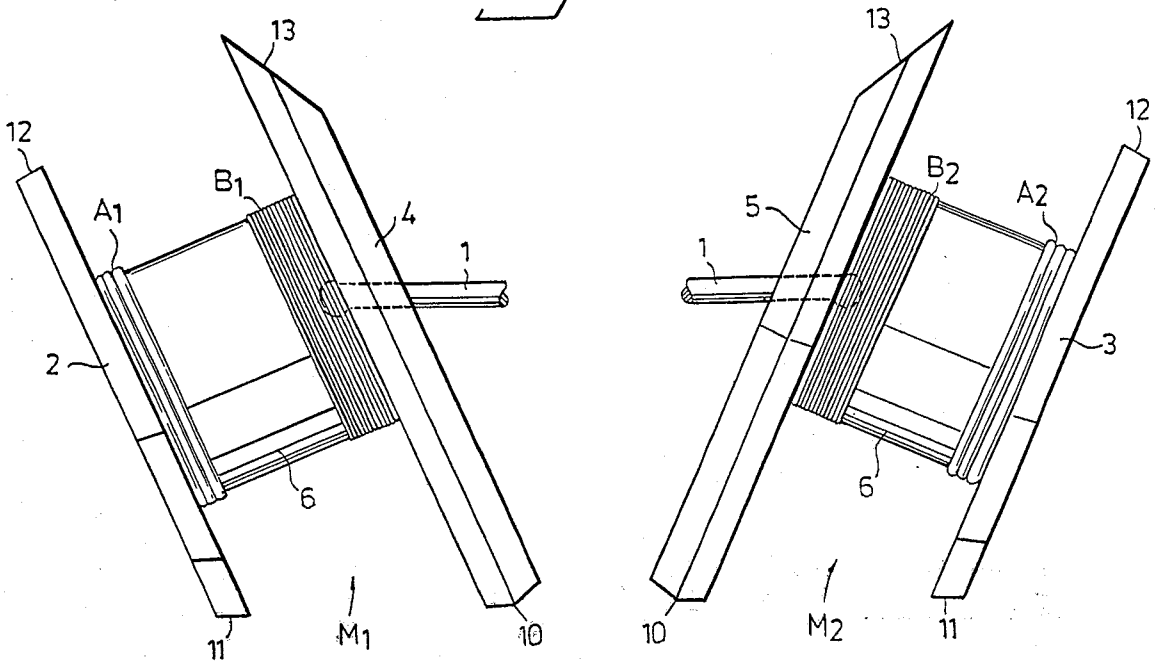
FIG. 2 illustrates the magnetic heads with their windings, as seen from one side. The embodiment illustrated on the drawings will now be described in detail.

The electromagnet in accordance with the invention is provided with two opposing magnetic heads $M_1$ and $M_2$. Each of these is provided with at least one electric winding $A_1$, $A_2$, respectively. The heads $M_1$, $M_2$ are connected to each other via a carrying shaft 1.

The magnetic heads $M_1$, $M_2$ of the electromagnet shown in the drawings are furthermore provided with a second electric winding $B_1$ and $B_2$, respectively.

The magnetic heads $M_1$ and $M_2$ are formed one to the opposite hand of the other. Each is provided with two opposing pole plates, an outer pole plate 2, 3 and an inner pole plate 4, 5. On the respective magnetic head $M_1$, $M_2$ the outer pole plate 2, 3 and the inner pole plate 4, 5 are mutually attached by a cylindrical core 6. Electrical windings $A_1$, $B_1$ and $A_2$, $B_2$ for the respective magnetic head $M_1$, $M_2$ are wound on the respective core 6.

The ends of the carrying shaft 1 connecting the magnetic heads $M_1$, and $M_2$ with each other are provided with ball joints, attached to the core 6 of the respective magnetic head $M_1$, $M_2$.

On the respective magnetic head $M_1$, $M_2$ the inner pole plate 4, 5 is formed with an aperture 7 directly opposite the cylindrical core 6. Said aperture opens out onto the core 6 where the ball joint is attached, and the carrying shaft 1 runs through the aperture 7 to the ball joint. The diameter of the aperture 7 is relatively large compared with the cross section of the carrying shaft 1, so that the magnetic heads $M_1$ and $M_2$ can assume positions at approximately 90° in relation to each other for ensuring that a planar surface at the edges of the pole plates 2, 4 and 3, 5 on the respective magnetic head $M_1$ and $M_2$ can be tipped into engagement against the surface of an iron object to be lifted by the electromagnet. By attaching the magnetic heads $M_1$ and $M_2$ to the carrying shaft 1 by ball joints, they are also turnable, so that a suitable portion of the edges of the pole plates 2, 4 and 3, 5 are turned into engagement against the iron object which is to be lifted by the electromagnet.

Turning and tipping the magnetic heads $M_1$ and $M_2$ is done when the windings A and B are connected to their current sources and the heads $M_1$ and $M_2$ are adjacent the iron object to be lifted.

An attachment 8 for a steel cable 9 is arranged at the middle of the carrying shaft 1. The magnetic heads $M_1$ and $M_2$, mounted at the ends of the carrying shaft 1, are raised and lowered with the help of the cable 9. The cable 9 goes to a point of support on a suspension means (not shown on the drawings) for the electromagnet. Raising and lowering the electromagnet is carried out by this suspension means.

Through the suspension of the electromagnet there will be, during a lift, a vertical line through the suspension point of the wire 9 in the suspension means, this line passes practically straight through the center of gravity for the magnetic heads $M_1$ and $M_2$ and the iron object which is to be lifted. Thus, it is ensured that the electromagnet always takes hold of the iron object to be lifted. This is of particularly great importance when the lifting work of the electromagnet is performed automatically.

To ensure that the pole plates 2, 4 and 3, 5 of the electromagnet will come into contact with the iron objects to be lifted with a sufficiently large surface in all positions, the lower edge 10 of the inner pole plates 4, 5 is double-chamfered. For the same reason, one or more edges 11, 12 on the outer pole plates 2, 3 are bevelled.

So that the cable 9 will not prevent the magnetic heads $M_1$ and $M_2$ from getting into line with the vertical line from the suspension point of the cable 9 in the suspension means for the electromagnet through the center of gravity of the magnetic heads and the iron object which is to be lifted, the upper edge 13 on the inner pole plates 4, 5 is provided with a wide acute bevel towards the cable 9.

The electromagnet is made magnetic and is demagnetized by the windings $A_1$, $B_1$ and $A_2$, $B_2$ on the respective magnetic head $M_1$ and $M_2$.

The first winding $A_1$, $A_2$ consists of a heavy-gauge wire with few turns.

The second winding $B_1$, $B_2$ consists of a fine-gauge wire with many turns.

To automatically seek out the iron object which is to be lifted by the electromagnet, the windings $A_1$, $A_2$ are connected to a weak DC source. When the electromagnet meets an iron object, a voltage is induced in the second winding $B_1$, $B_2$. The voltage impulse can then go to the control means of the electromagnet to lower the electromagnet towards the iron object to be lifted.

Energizing the magnet is done by a powerful DC source being connected to the windings $A_1$ and $A_2$. This current is several times as great as the normal working current of the magnet. The magnet will then twist towards the goods intended for handling.

After connecting the windings $A_1$ and $A_2$ to the heavy DC source for a given time, they are switched to the normal electrical lifting power, i.e. normal current strength. Further, the electromagnet in accordance with the invention can be provided with a demagnetizing coil supplied with low-frequency AC current at 2–10 Hertz, which causes the residue magnetism to decay and prevents an iron object handled by the electromagnet from being magnetized or becoming attached to the magnet.

The magnetic heads $M_1$ and $M_2$ are mounted at the ends of the carrying shaft 1. The carrying shaft 1 is of a length such that the magnetic fields from the respective magnetic head generated during lifting with the magnets will not interfere with each other.

An example of how the electromagnet in accordance with the invention can operate for automatic handling of unoriented iron objects will now be described.

A braced framework is constructed such that two standard loading pallets can be placed side-by-side inside it. The framework is constructed such that a trolley, carried in the upper portion of the framework, can reach all points in the layout plan of the pallets. The trolley carries the electromagnet in accordance with the present invention, and the electromagnet is arranged to be raised and lowered. It is assumed that the framework is placed at a painting line loop.

A truck driver sets down two pallets inside the framework. One pallet is loaded with painted iron details. The other is an empty pallet. The electromagnet is taken by the trolley over the loaded pallet. Its movement follows its programming. The electromagnet then functions as a transmitter for the movements of the trolley.

When the electromagnet approaches an iron object, a voltage is induced in the windings $A_2$ and $B_2$. The search is arrested. The electromagnet is switched over to the magnetic function. Its exact position in space can be programmed, e.g. by a magnetizable steel tape, fitted parallel to a driving cylinder on the trolley. After the magnetizing winding of the electromagnet has been coupled in, an iron article is attracted to the electromagnet and the latter is lifted together with the article.

The article lifted by the electromagnet is conveyed together with the electromagnet by the trolley to an unloading station on the painting line.

Demagnetization is switched on to unload the iron article. This is done with AC current at a frequency of 2–10 Hertz. This facilitates release of light iron goods which have been magnetized. The demagnetization also makes subsequent work on the iron article easier.

The electromagnet is subsequently taken by the trolley to a station for ready-painted iron articles. There, an iron article is lifted by the electromagnet and taken by the trolley to the empty pallet. The article is loaded onto the empty pallet at the same location as it was lifted from the full pallet.

To obtain a satisfactory system for providing impulses for the movements of the electromagnet, one or more magnetizable steel tape can be fitted parallel to the path of the trolley, and for the raising and lowering movements of the electromagnet. A plurality of fixed and movable magnetizing and demagnetizing heads are fitted for every such magnetizable steel tape, or the like. These heads are made so that the information point on the steel tape is either momentary or elongate. By "elongate information point" is meant a magnetic curve on the tape which is decreasing, either in power, frequency or form.

I claim:

1. An electromagnet for automatic handling of objects comprising:

a carrying shaft;

two opposing magnetic heads each including more than one electric winding, said magnetic heads being rotatably mounted on said carrying shaft for assuming angular positions relative to each other;

an attachment member positioned at approximately a midpoint of said carrying shaft;

a lifting means connected to said attachment member for raising and lowering the magnetic heads;

said magnetic heads each including a central portion and an inner pole plate having an aperture therein;

said carrying shaft including ends positioned within respective apertures of said magnetic heads to rotatably connect said magnetic heads to said carrying shaft and to permit said magnetic heads to assume angular positions relative to each other;

first windings on each of the respective magnetic heads being connectable to an electrical source for seeking out a metallic object by inducing a voltage in a second winding on each of the respective magnetic heads when the metallic object is approached; and at least one of said first windings on the respective magnetic heads being connectable to a powerful electrical source to twist the magnetic heads towards the metallic object and after a predetermined time said at least one of said first windings being connectable to at least a normal electrical source to effect a lifting of said metallic object.

2. An electromagnet according to claim 1, wherein each of said central portions of said magnetic heads includes a joint socket and each end of said carrying shaft includes a joint member, each of said joint members being positioned within respective joint sockets to rotatably connect said magnetic heads to said carrying shaft.

3. An electromagnet according to claim 2, wherein said joint members and said joint sockets are ball and socket connections.

4. An electromagnet according to claim 1, wherein said first windings on each of said magnetic heads is a heavier gauge wire consisting of fewer turns in relationship to said second windings consisting of a finer gauge wire consisting of many turns.

5. An electromagnet according to claim 1, wherein windings on each of the magnetic heads are reverse wound with respect to the other.

6. An electromagnet according to claim 1, wherein the electrical source is direct current.

7. An electromagnet according to claim 1, wherein each magnetic head is provided with an outer pole plate and said inner plate connected together by said central portion.

8. An electromagnet according to claim 7, wherein an edge on the outer pole plates of the magnetic heads is bevelled.

9. An electromagnet according to claim 7, wherein a lower edge on the inner pole plates of said magnetic heads is double-chamfered.

10. An electromagnet according to claim 7, wherein an upper edge on the inner pole plates of the magnetic heads is provided with a wide acute bevel.

11. Electromagnet for automatic handling of iron objects comprising:

an electromagnet including two opposing magnetic heads each provided with more than one electric winding, said magnetic heads being turnably attached to a carrying shaft for assuming angular positions in relation to each other;

attachment means being positioned at approximately a midpoint of said carrying shaft for raising and lowering the magnetic heads;

said carrying shaft including ends movable with play in an aperture in respective inner pole plates of the magnetic heads;

said ends of the carrying shaft being provided with ball joints, attached to the magnetic heads so that when the electromagnet is lifted, a vertical line from a suspension point of said attachment means for the electromagnets passes substantially straight through the center of gravity for the magnetic heads and an iron object, which is to be lifted;

first windings on each of the respective magnetic head being connectable to a DC source for seeking out the iron object by inducing a voltage when the object is approached; and two windings on the second magnetic head being connectable to a powerful DC source in order to turn the electromagnet towards the iron object, intended to be lifted.

12. Electromagnet according to claim 11, wherein when two windings on each of the magnetic heads are used, the first winding on the first magnetic head is connectable to the powerful DC source a predetermined time after connecting the second winding on the second magnetic head to the powerful DC source.

13. Electromagnet according to claim 11 or 12, wherein the first windings on the respective magnetic heads are connectable to a normal DC source a predetermined time after connecting one of the first windings to a powerful DC source, to develop normal lifting power in the magnetic heads.

14. Electromagnet according to claim 13, wherein the ball joints are fixed in a cylindrical core in each of the magnetic heads.

15. Electromagnet according to claim 14, wherein windings on each of the magnetic heads are reverse wound with respect to the other, and each magnetic head being provided with two opposing pole plates, an outer pole plate and an inner pole plate, connected together by the cylindrical core.

16. Electromagnet according to claim 15, wherein an edge on the outer pole plates of the magnetic heads is bevelled.

17. Electromagnet according to claim 16, wherein a lower edge on the inner pole plates of the magnetic heads is double-chamfered.

18. Electromagnet according to claim 17, wherein an upper edge on the inner pole plates of the magnetic heads is provided with a wide acute bevel.

* * * * *

UNITED STATES PATENT AND TRADEMARK OFFICE

CERTIFICATE OF CORRECTION

PATENT NO. : 4,334,708

DATED : June 15, 1982

INVENTOR(S) : Westin

It is certified that error appears in the above—identified patent and that said Letters Patent is hereby corrected as shown below:

On the title page, "[30] Foreign Application Priority Data" change "Oct. 11, 1978 [DE] Fed. Rep. of Germany .... 7810640" to --Oct. 11, 1978 [SE] Sweden .... 7810640--

Signed and Sealed this

*Fifth* Day of *October 1982*

[SEAL]

*Attest:*

GERALD J. MOSSINGHOFF

*Attesting Officer*

*Commissioner of Patents and Trademarks*